US007021904B2

(12) United States Patent
Shimizu

(10) Patent No.: US 7,021,904 B2
(45) Date of Patent: Apr. 4, 2006

(54) SWASH PLATE TYPE HYDRAULIC PUMP OR MOTOR

(75) Inventor: Takeo Shimizu, Tokyo (JP)

(73) Assignee: Kayaba Industry Co., Ltd., Tokyo (JP)

( * ) Notice: Subject to any disclaimer, the term of this patent is extended or adjusted under 35 U.S.C. 154(b) by 0 days.

(21) Appl. No.: 10/950,685

(22) Filed: Sep. 28, 2004

(65) Prior Publication Data

US 2005/0123412 A1 Jun. 9, 2005

(30) Foreign Application Priority Data

Sep. 29, 2003 (JP) ..... 2003-338552
Sep. 29, 2003 (JP) ..... 2003-338578

(51) Int. Cl.
*F01B 13/04* (2006.01)
*F04B 19/00* (2006.01)

(52) U.S. Cl. ..... 417/269; 417/488; 91/501; 91/506; 92/12.2

(58) Field of Classification Search ..... 417/269, 417/487, 488, 501; 91/501, 506; 92/12.2; 74/839
See application file for complete search history.

(56) References Cited

U.S. PATENT DOCUMENTS 3,093,081 A 6/1963 Budzich
3,265,008 A 8/1966 Ward
3,807,283 A * 4/1974 Alderson et al. ..... 91/499
5,630,352 A * 5/1997 Todd ..... 92/12.2
6,361,282 B1 * 3/2002 Wanschura ..... 417/206

FOREIGN PATENT DOCUMENTS

| | | |
|---|---|---|
| FR | 1397039 | 8/1965 |
| FR | 1428924 | 2/1966 |
| FR | 2190174 | 1/1974 |
| GB | 865648 | 4/1961 |
| JP | 50-115304 | 9/1975 |

* cited by examiner

*Primary Examiner*—Charles G. Freay

(74) *Attorney, Agent, or Firm*—Rabin & Berdo, PC

(57) ABSTRACT

A swash plate type hydraulic pump or motor comprises first and second swash plates which move reciprocally while opposing first and second pistons, so as to expand and contract a volume chamber according to rotation of a cylinder block. Drive pistons push on the swash plates from behind, causing the first and second swash plates to tilt, respectively. A tilt angle control valve controls the tilt angles of the swash plates by selectively increasing drive pressures that are guided to the drive pistons. A port plate is provided in a sliding portion between the first swash plate and the first piston. The port plate rotates integrally with the cylinder block and guides high and low pressure side hydraulic fluid, which flows through the supply and discharge ports provided in a sliding surface of the first swash plate, to the volume chamber via an inner portion of each first piston.

4 Claims, 12 Drawing Sheets

SWASH PLATE TYPE HYDRAULIC PUMP OR MOTOR

FIELD OF THE INVENTION

This invention relates to a swash plate type hydraulic pump or motor capable of being applied to hydrostatic transmission, hereinafter called HST, which is used in a running gear or the like in agricultural machinery, industrial vehicles, and construction machinery.

BACKGROUND OF THE INVENTION

HST is a combination of a hydraulic pump and a hydraulic motor. Consequently, by changing the tilt angle of a swash plate in the hydraulic pump, and by changing the discharge amount in a range from zero to a maximum discharge amount, the rotational velocity of the hydraulic motor changes. A vehicle can thus continuously change speeds from a stopped state to a maximum forward or reverse speed.

Structures that comprise a single swash plate, a cylinder block, and a plurality of pistons that are housed on only one side of the cylinder block are often used as HST hydraulic pumps or hydraulic motors.

However, the size of the HST hydraulic pump or the hydraulic motor becomes large when a high volume is needed in the HST hydraulic pump or the hydraulic motor, respectively. In this case, a large space for mounting the HST to a vehicle is required, and this is detrimental to efficiency and cost.

An opposing type swash plate hydraulic pump or motor comprising not one swash plate, but instead a pair of swash plates opposing each other, has been proposed in JP 50-115304 A as a way to make it possible to reduce the size of a hydraulic pump or a hydraulic motor.

SUMMARY OF THE INVENTION

The opposing type swash plate hydraulic pump or motor has swash plates disposed on either side of a cylinder block so as to oppose each other. A plurality of pistons are housed in the cylinder block from both sides thereof, and the pistons stroke according to the tilt angle of each of the swash plates.

In this case the number of pistons can be increased even if the cylinder block is not made larger in size. Accordingly, the volume of cylinder block can increase when used in a hydraulic pump or a hydraulic motor.

However, the tilt angles of the plurality of swash plates do not change. Consequently, the capacity is constant, and in particular, the swash plates are not suited for use in the HST pump or motor described above.

It is an object of this invention is to provide an opposing type swash plate hydraulic pump or motor in which the tilt angles of a pair of swash plates are freely changeable, and a large volumetric change ratio can be achieved.

To attain the above object, this invention provides a swash plate type hydraulic pump or motor. The swash plate type hydraulic pump or motor comprises: a cylinder block supported within a pump case so as to freely rotate; a plurality of first cylinder bores and a plurality of second cylinder bores which are formed axially on both sides of the cylinder block, the first cylinder bores and the second cylinder bores communicating with each other; first pistons and second pistons which are inserted into the first cylinder bores and the second cylinder bores from both the sides of the cylinder block; volume chambers formed in inner portions of the first cylinder bores and the second cylinder bores and defined by the first pistons and the second pistons; a first swash plate and a second swash plate which are disposed axially on both the sides of the cylinder block and to which the first pistons and the second pistons contact freely to slide, respectively; a first swash plate bearing and a second swash plate bearing which support the first swash plate and the second swash plate so as to be free to tilt, respectively; drive pistons that cause the first swash plate and the second swash plate to tilt; a hydraulic pressure control valve which selectively controls a hydraulic pressure acting on the drive pistons; a pair of supply and discharge ports formed in a sliding surface of the first swash plate, the pair of supply and discharge ports being connected to a hydraulic fluid high pressure side and a hydraulic fluid low pressure side, respectively; and a port plate disposed in a sliding portion between the first swash plate and the first pistons, the port plate rotating integrally with the cylinder block and guiding the high pressure side hydraulic fluid and the low pressure side hydraulic fluid of the supply and discharge ports to the volume chambers via inner portions of the first pistons.

DETAILED DESCRIPTION OF THE PREFERRED EMBODIMENTS

Embodiments of this invention applied to a hydraulic motor of an HST installed in an industrial vehicle or the like will be explained below based on the appended drawings.

Figure 1:
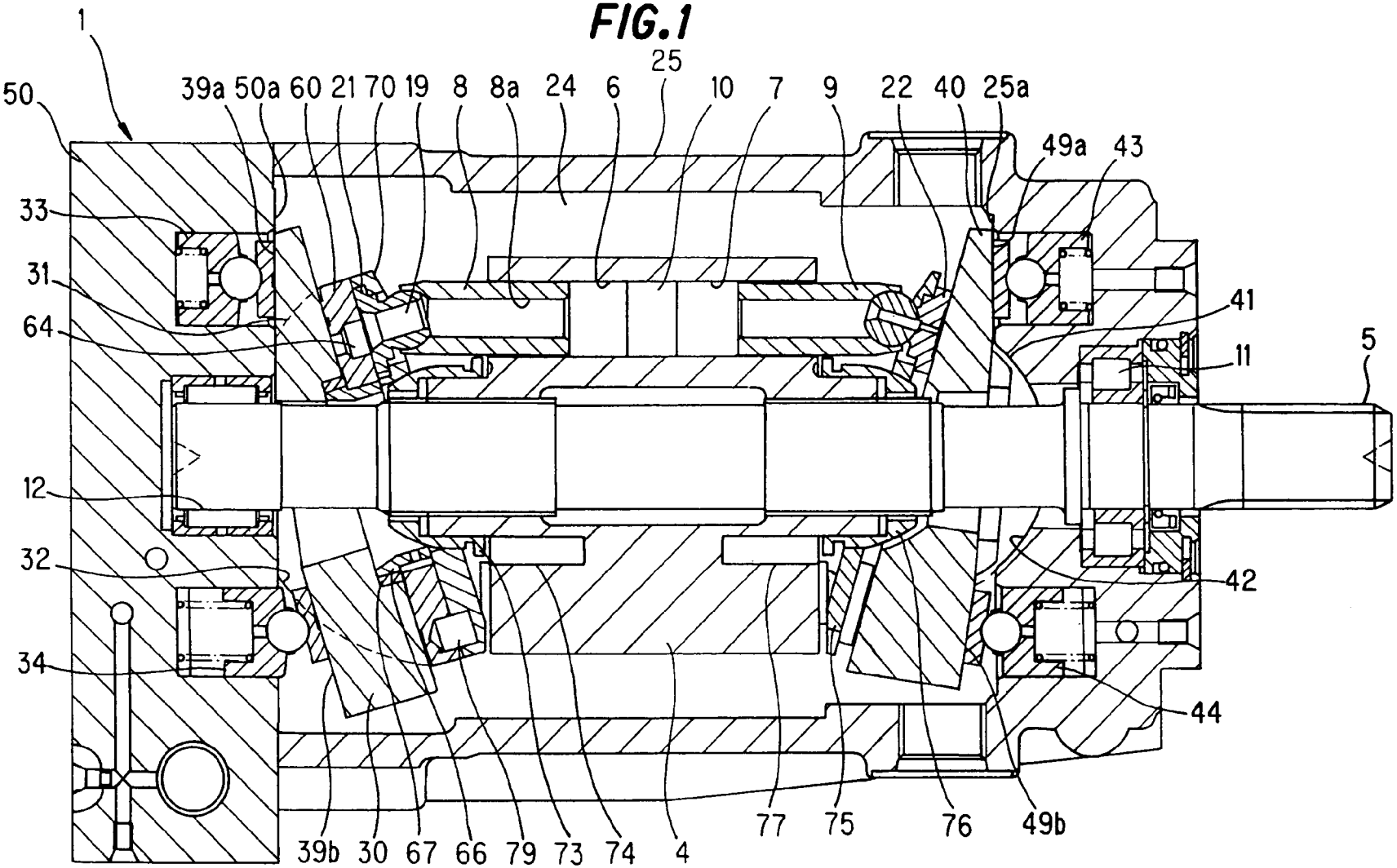
FIG. 1 is a cross sectional view of a hydraulic motor according to an embodiment of this invention.

Referring to FIG. 1, a hydraulic motor 1 comprises a cylindrical case 25 and a port block 50, which form a housing chamber 24. A cylinder block 4, a first swash plate 30, and a second swash plate 40 are housed in the housing chamber 24.

A shaft 5 passes through a rotation axis center of the cylinder block 4, and the shaft 5 and the cylinder block 4 are mutually connected. The shaft 5 is supported at one end thereof by the port block 50, through a bearing 12, and is supported at the other end thereof by the case 25, through a bearing 11. A portion of the shaft 5 projects out to the outside from a side wall of the case 25, and rotation of the shaft 5 is transmitted to left and right wheels of a vehicle through a transmission and a differential gear (both not shown).

A first cylinder bores 6 and a second cylinder bores 7 are formed in the cylinder block 4 on both sides of the cylinder block in the axial direction. The first cylinder bores 6 and the second cylinder bores 7 are connected together and disposed in parallel with the rotation axis of the cylinder block 4. Further, a plurality of the first cylinder bores 6 and the second cylinder bores 7 are arranged at a fixed spacing on a pitch circle P.C centered about the rotation axis of the cylinder block 4.

A first piston 8 and a second piston 9 are inserted into the first cylinder bore 6 and the second cylinder bore 7, respectively, defining a volume chamber 10 between the first piston 8 and the second piston 9.

One end of the first piston 8 and one end of the second piston 9 project out from both end surfaces of the cylinder block 4, and are connected with shoes 21 and 22 that contact the first swash plate 30 and the second swash plate 40, respectively.

The shoes 21 that are connected to a distal end portion of each first piston 8, a retainer plate 70 that holds the shoes 21, and a hollow disk port plate 60 that contacts each of the shoes 21 are provided in order to move each of the first pistons 8 reciprocally, following an inclined surface of the first swash plate 30. The port plate 60 slides in contact with the first swash plate 30 while rotating integrally with the cylinder block 4.

Further, the shoes 22 that are connected to a distal end portion of each second piston 9, and a retainer plate 75 that holds the shoes 22 so as to be in contact with the second swash plate 40 are provided in order to move the second pistons reciprocally, following an inclined surface of the second swash plate 40.

As discussed hereinafter, when hydraulic fluid is supplied to the volume chamber 10, the first piston 8 and the second piston 9 extend while contacting the first swash plate 30 and the second swash plate 40, respectively. A rotational force is generated on the cylinder block 4 at this time. When the first piston 8 and the second piston 9 are pushed by the first swash plate 30 and the second swash plate 40 to move in a retracting direction, hydraulic fluid discharges from the volume chamber 10, and the cylinder block 4 thus rotates in the same direction.

The tilt angles of the first swash plate 30 and the second swash plate 40 are made freely changeable in order to make the effective capacity of the hydraulic motor 1 variable, or in other words, in order to make the displacement volume per single rotation variable.

Consequently, a part of a rear surface 31 of the first swash plate 30 and a part of a rear surface 41 of the second swash plate 40 are formed in a semicircular shape. The semicircular rear surfaces 31 and 41 are supported by first and second swash plate bearings 32 and 42 also having a circular shape so as to be free to slide, responsively.

Figure 6:
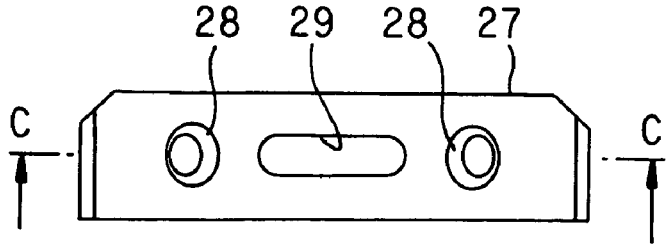
FIG. 6A is a front view of a plain bearing.
FIG. 6B is a cross sectional view of the plain bearing taken along a line C—C.
Figure 6:
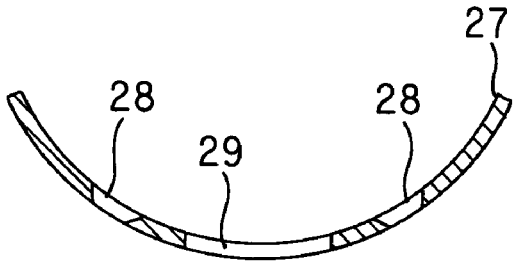

Referring to FIGS. 6A and 6B, more specifically, a plain bearing 27 having a semicircular shape is provided in each of the first swash plate bearing 32 and the second swash plate bearing 42. The plain bearing 27 has a pair of holes 28, and is fastened to the case 25 or to the port block 50 with two screws that pass through the holes 28.

A mechanism for performing supply and discharge of hydraulic fluid to and from the volume chamber 10 is explained next.

Figure 2A:
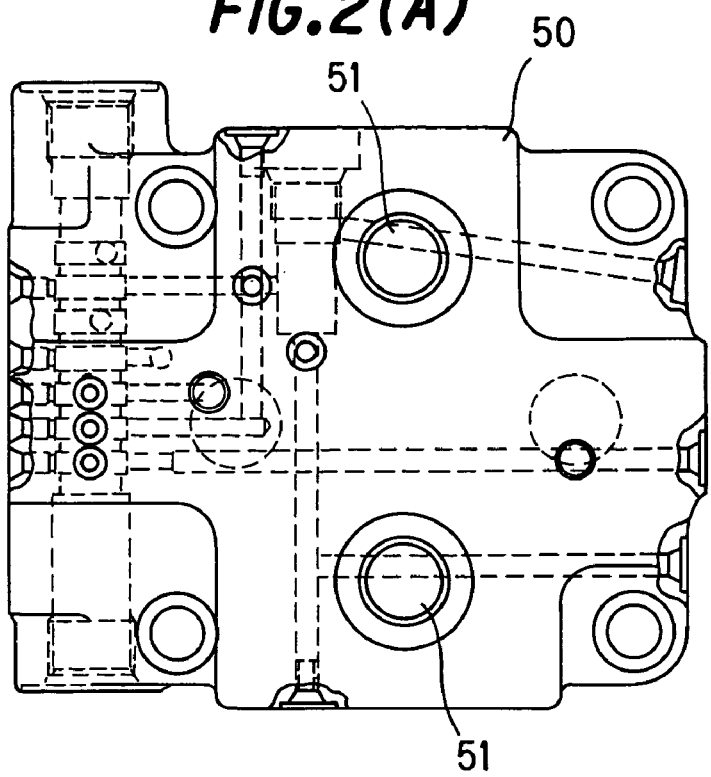
FIG. 2A is a left front side view of a port block.
Figure 2C:
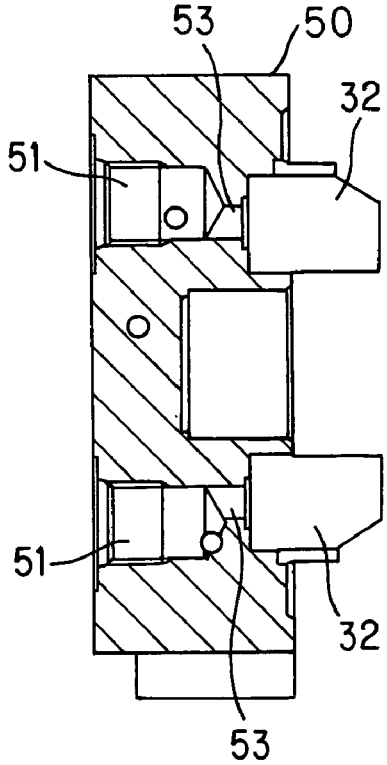
FIG. 2C is a cross sectional view of the port block taken along a line B—B.
Figure 2B:
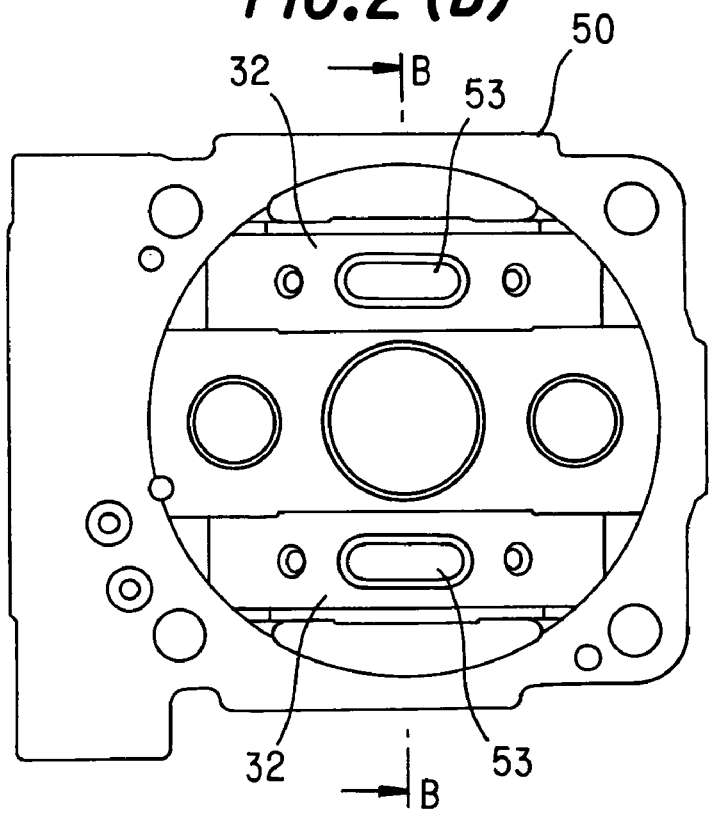
FIG. 2B is a right front side view of the port block.

Referring to FIGS. 2A, 2B, and 2C, first, a pair of entrance and exit openings 51 are formed in the port block 50. The entrance and exit openings 51 communicate with a high pressure side and a low pressure side of a hydraulic pump through pipes (not shown).

The entrance and exit openings 51, and a pair of bearing pass-through ports 53 that communicate with the first swash plate bearing 32 are formed in the port block 50. Long holes 29 that communicate with the bearing pass-through ports 53 are formed in the plain bearings 27 (shown in FIG. 6) that are attached to the first swash plate bearing 32. It should be noted that the long holes 29 (shown in FIG. 6) extend in a circumferential direction of the first swash plate bearing 32.

Figure 3D:
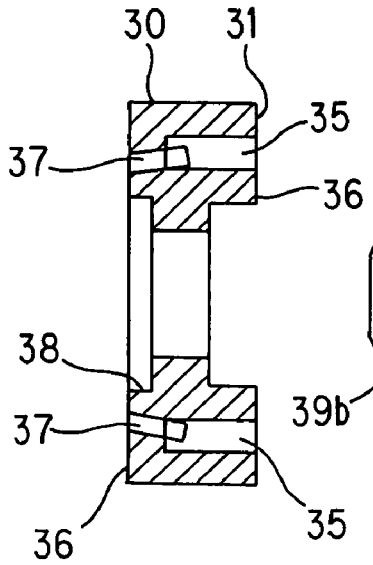
FIG. 3D is a cross sectional view of the first swash plate taken along a line D—D.
Figure 3A:
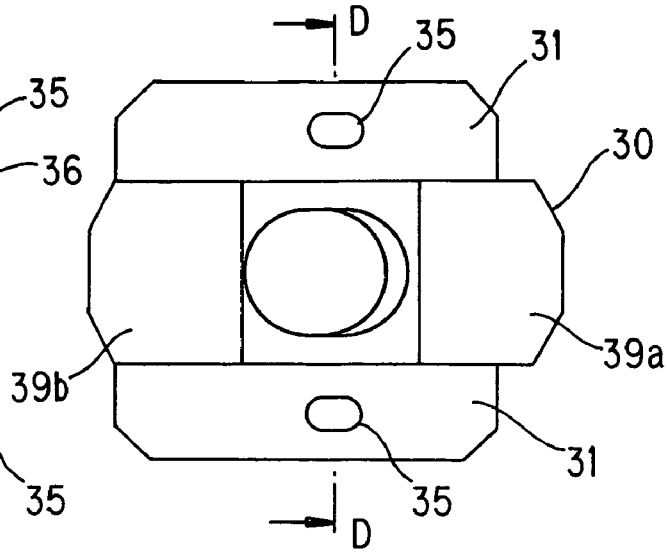
FIG. 3A is a right front side view of a first swash plate.
Figure 3B:
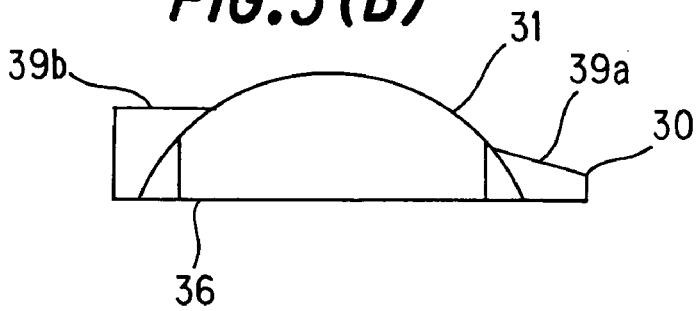
FIG. 3B is a side view of the first swash plate.
Figure 3C:
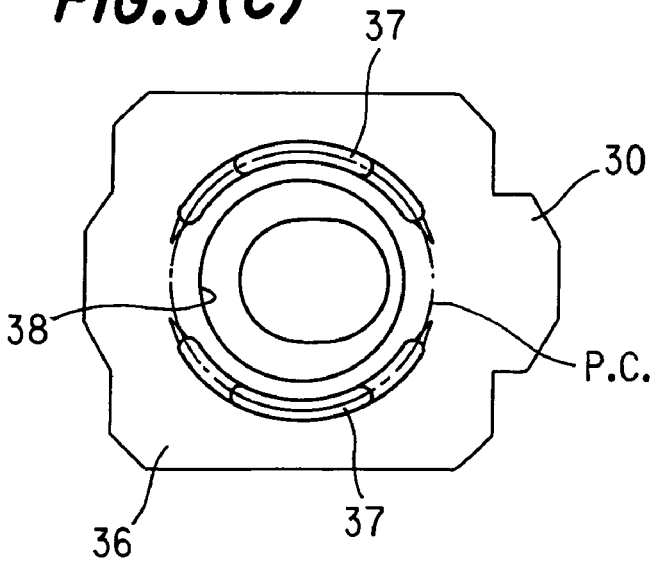
FIG. 3C is a right front side view of the first swash plate.

Referring to FIGS. 3A, 3B, and 3C, a through hole 35 is formed in each of the pair of semicircular rear surfaces 31 of the first swash plate 30, which is supported by the pair of first swash plate bearings 32 so as to be free to slide. The through holes 35 always communicate with the long holes 29 of each plain bearing 27, irrespective of the tilt angle of the first swash plate 30.

A pair of supply and discharge ports 37, into which a high pressure hydraulic fluid and a low pressure hydraulic fluid are guided, are provided in a sliding surface 36 where the shoes 21 of the first piston 8 contact the first swash plate 30, so as to be arranged symmetrically. The supply and discharge ports 37 are formed having arc shapes along the pitch circle P.C on the same circumference, with the rotation axis of the cylinder block 4 as a center. The supply and discharge ports 37 communicate with the through holes 35, and supply or discharge the hydraulic fluid.

It should be noted that, as described hereinafter, a connection between the high pressure side and the low pressure side becomes reversed with respect to the pair of supply and discharge ports 37 according to the rotation direction of the cylinder block 4.

Figure 4A:
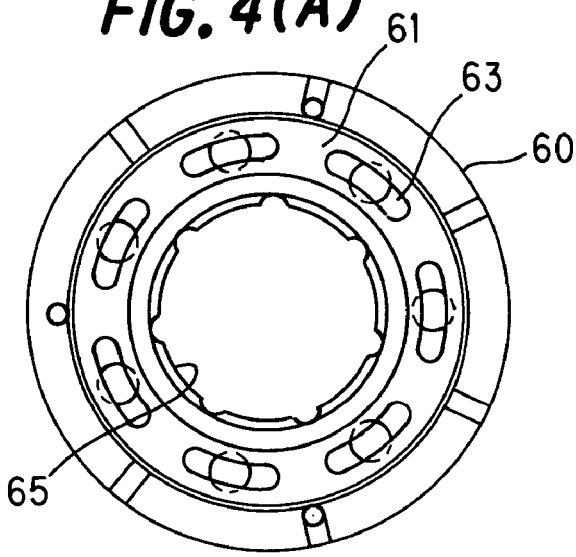
FIG. 4A is a left front side view of a port plate.
Figure 4B:
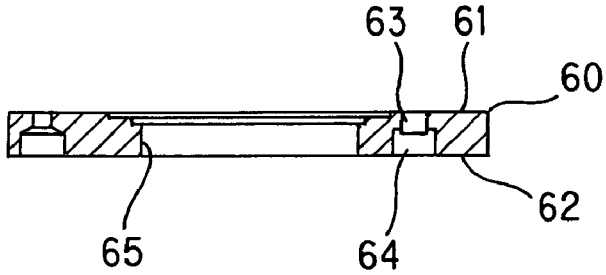
FIG. 4B is a cross sectional view of the port plate taken along a line E—E.
Figure 4C:
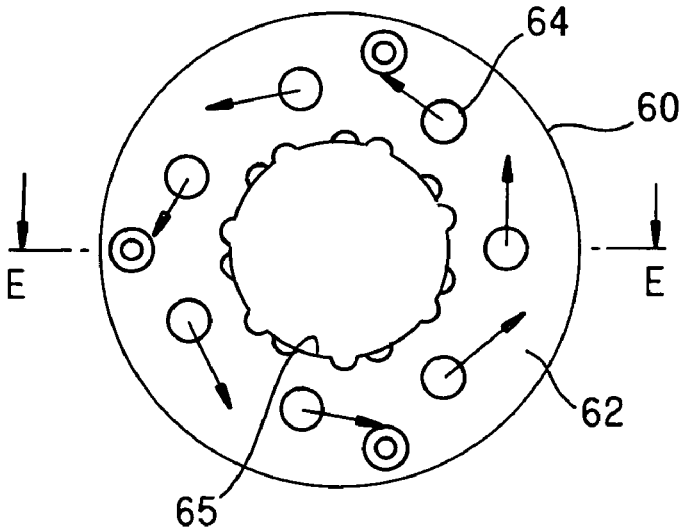
FIG. 4C is a right front side view of the port plate.

The disk-shaped port plate 60 is disposed between the shoes 21 and the first swash plate 30. Referring to FIGS. 4A, 4B, and 4C, the disk-shape port plate 60 have on its both sides a sliding surface 61 that contacts the sliding surface 36 of the first swash plate 30 and a sliding surface 62 that contacts the shoes 21, respectively. Long holes 63 are opened in the sliding surface 61. The long holes 63 are disposed at equal intervals in a circumferential direction and extend in a circular arc shape. The long holes 63 communicate with the supply and discharge ports 37 (shown in FIG. 4). A plurality of valve ports 64 equal to the number of the first pistons 8 are disposed at equal intervals in the circumferential direction in the sliding surface 62. The valve ports 64 are connected to the long holes 63. The valve ports 64 communicate with shoe ports 19 of the shoes 21, which are connected to the sliding surface 62. The shoe ports 19 of the shoes 21 communicate with the volume chambers 10 between the cylinder bores by means of a through hole 8*a* running through the center of the first piston 8.

Therefore, when the cylinder block 4 rotates relative to the first swash plate 30, the shoes 21 move along with the valve plate 60 in the rotation direction of the cylinder block 4 with respect to the pair of supply and discharge ports 37 that are opened in the sliding surface 36 of the first swash plate 30. Each of the volume chambers 10 is thus connected in turn. The first piston 8 thus extends out in a region connected to the high pressure side supply and discharge port 37, and the first piston 8 contracts in a region connected to the low pressure side supply and discharge port 37. Rotation of the cylinder block 4 thus continues.

In this case the rotation direction of the cylinder block 4 reverses when the supply of the high pressure side hydraulic fluid and the low pressure side hydraulic fluid becomes reversed with respect to the pair of supply and discharge ports 37.

It should be noted that, as described hereinafter, the cylinder bores 6 and 7 communicate with each other to firm the common volume chamber 10 for the second piston 9 as well. Accordingly, as the cylinder block 4 rotates, the second piston 9 also moves in a similar reciprocal manner by the volume chamber 10 connecting in turn to the high pressure side and the low pressure side. A force that causes the cylinder block 4 to rotate thus also develops on the second piston side. This force becomes a motor drive force.

An annular guide sleeve 66 is provided in order to perform positioning so that the port plate 60 slides in contact with the first swash plate 30 while maintaining the same positional relationship at all times.

A portion of the guide sleeve 66 fits into an inner circumferential portion 65 of the port plate 60, while another portion of the guide sleeve 66 slides in contact with an inner circumferential portion 38 of the first swash plate 30 through an annular plain bearing 67.

Figure 7A:
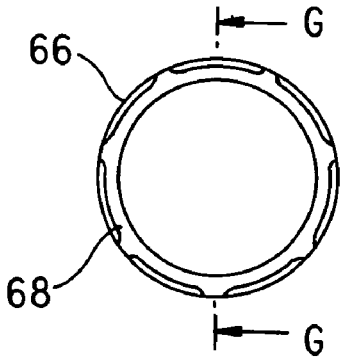
FIG. 7A is a front view of a guide sleeve.
Figure 7B:
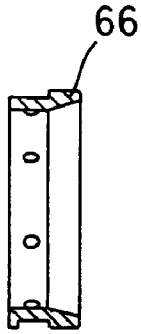
FIG. 7B is a cross sectional view of the guide sleeve taken along a line G—G.

As shown in detail in FIGS. 7A and 7B, uneven portions 68 are provided at a predetermined pitch in an outer circumferential portion of the guide sleeve 66. Relative rotation of the guide sleeve 66 with respect to the port plate 60 is prevented by the uneven portions 68 fitting in the inner circumferential portion 65 of the port plate 60 as shown in FIG. 4C. The inner circumferential portion 65 also includes unevennesses arranged at the same pitch as that of the uneven portions 68.

By rotating the port plate 60 along a predetermined trajectory with respect to the sliding surface 36 of the first swash plate 30 through the guide sleeve 66, a suitable connection timing for each of the volume chambers 10 with respect to the supply and discharge ports 37 can be maintained. In other words, a suitable hydraulic fluid supply and discharge timing can be maintained.

Figure 5A:
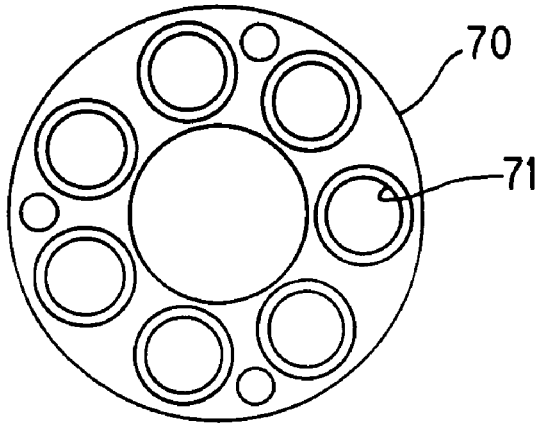
FIG. 5A is a left front side view of a retainer plate.
Figure 5B:
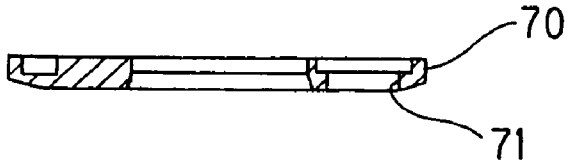
FIG. 5B is a cross sectional view of the retainer plate taken along a line F—F.
Figure 5C:
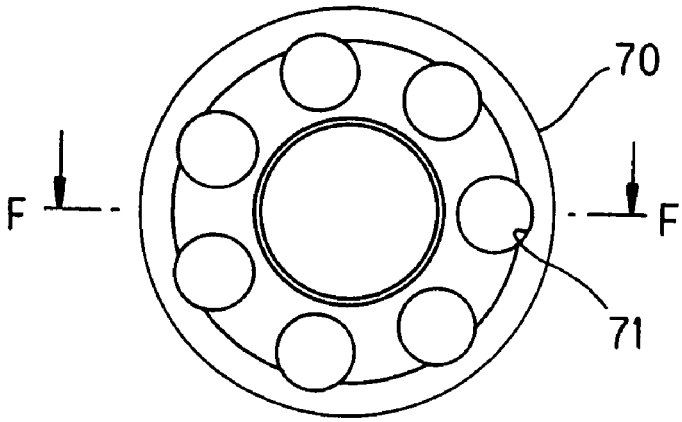
FIG. 5C is a right front side view of the retainer plate.

Referring to FIGS. 5A, 5B, and 5C, the retainer plate 70 is provided in order to regulate the relative position of the port plate 60 with respect to the shoes 21.

Referring to FIGS. 5A, 5B, and 5C, holes 71 through which the shoes 21 pass are formed in the disk-shaped retainer plate 70 at equal intervals in the circumferential direction. The opening diameter of the holes 71 is formed larger than the outer diameter of the shoes 21 that fit into the holes 71. The shoes 21 can thus slide slightly inside the holes 71 with respect to the port plate 60.

Further, referring to FIG. 1, pins 79 are disposed between the port plate 60 and the retainer plate 70, thus stopping relative rotation of the port plate 60 and the retainer plate 70. The port plate 60 rotates together with the cylinder block 4 with respect to the first swash plate 30, through the retainer plate 70.

Center springs 74 are provided in order to push the shoes 21 against the first swash plate 30 through the port plate 60. A hemispherical retainer holder 73 that fits into a boss portion of the cylinder block 4 is provided. The retainer holder 73 fits into an inner circumference of the retainer plate 70, and the retainer spring 74 pushes the retainer plate 70 in an axial direction.

The center springs 74 press the shoes 21 onto the first swash plate 30, through the port plate 60. Consequently, the port plate 60 is thus restrained from floating up from the first swash plate 30 due to hydraulic fluid pressure that develops during start-up of the motor. In addition, the shoes 21 are restrained from floating up from the port plate 60. Good supply and discharge of the hydraulic fluid can thus be maintained, without hydraulic fluid leaks.

Further, the retainer plate 75 that engages with the shoes 22, a retainer holder 76 that is seated on an inner circumferential portion of the retainer plate 75 so as to be slidable, and a plurality of center springs 77 that are provided in a compressed state between the retainer holder 76 and the cylinder block 4 are similarly provided on the second swash plate 40 side, opposite to the first swash plate 30, as means for pressing the shoes 22 of the second piston 9 onto the second swash plate 40.

By appropriately setting the pressure receiving surface area for the hydraulic fluid on the supply and discharge ports 37 of the port plate 60, and the like, a load that presses the port plate 60 onto the first swash plate 30 due to hydraulic pressure is made smaller than a load that causes the port plate 60 to float up. The port plate 60 thus does not float up from the first swash plate 30, and the sealing property between the port plate 60 and the first swash plate 30 are maintained. Hydraulic fluid guided into the supply and discharge port 37 thus forms an oil film between the first swash plate 30 and the port plate 60, which can function as a hydrostatic bearing that supports the first swash plate 30 at low friction with respect to the port plate 60.

In addition, by appropriately setting the pressure receiving surface area of the shoes 21, the load that presses the shoes 21 onto the port plate 60 is made smaller than the load causing the shoes 21 to float up. The shoes 21 thus do not float up from the port plate 60, thus maintaining the sealing property between the port plate 60 and the shoes 21. Hydraulic fluid guided into the supply and discharge port 37 thus forms an oil film between the port plate 60 and the shoes 21, functioning as a hydrostatic bearing that supports the shoes 21 with respect the port plate 60 at low friction.

The shoes 21 on the first swash plate 30 side are pressed against the port plate 60, through the first piston 8, due to hydraulic fluid pressure that is generated in the volume chambers 10. However, a lifting force develops due to action of the hydrostatic bearing by a pocket that forms in a bottom surface of the shoes 21. Consequently, the shoes 21 are pressed against the port plate 60 by a force that equals the difference between the pressing force and the lifting force.

Further, the port plate 60 is similarly pressed against the first swash plate 30 by a force that equals the difference between the pressing force due to the hydraulic pressure that acts on a front surface of the port plate 60, and a lifting force that develops due to hydraulic pressure acting on a rear surface of the port plate 60.

A pressing ratio is defined as pressing force divided by lifting force. With this invention, the pressing ratio of the shoes 21 onto the port plate 60 is set to be larger than the pressing ratio of the port plate 60 onto the first swash plate 30. A frictional force between the port plate 60 and the first swash plate 30 is thus made smaller than a frictional force between the shoes 21 and the port plate 60.

As shown by an arrow in FIG. 4C, a component force in a radial direction that develops in the first piston 8 on the first swash plate 30 side due to pressure guided into the volume chambers 10 acts to rotate the port plate 60, through the shoes 21, while causing the cylinder block 4 to rotate. The pressing ratio of the shoes 21 is larger than the pressing ratio of the port plate 60 at this point. Accordingly, when the coefficients of friction on the sliding surfaces of the port plate 60 and the shoes 21 are equal, sliding does not occur in the rotation direction between the shoes 21 and the port plate 60. Sliding does occur, however, between the port plate 60 and the first swash plate 30.

When the hydraulic motor is actually driven, the lubrication state between the port plate 60 and the first swash plate 30 at high relative velocity becomes more favorable, and the coefficient of friction decreases. The above tendency is thus promoted more and more.

Consequently, during normal operation, the shoes 21 on the first swash plate 30 side can rotate the port plate 60 by frictional forces.

In other words, the port plate 60 slides smoothly with respect to the first swash plate 30 due to the difference in the frictional forces that act on both sides of the port plate 60, and rotates together with the cylinder block 4. Thus, even if a relative positional relationship between the port plate 60 and the shoes 21 is not regulated by the retainer plate 70, for example, the port plate 60 rotates together with the cylinder block 4, while the shoes 21 only slide in the radial direction with respect to the port plate 60.

Even if the balance between the frictional forces acting on both surfaces of the port plate 60 is lost, the port plate 60 rotates together with the cylinder block 4 through the retainer plate 70, and operation of the hydraulic motor 1 can be maintained.

The forces that rotate the port plate 60 by the shoes 21 are the frictional forces between the shoes 21 and the port plate 60 in a normal operation state. However, during motor start-up or when there are large fluctuations in rotation and pressure while driving, the pressing ratio of the shoes 21 decreases transiently, and the frictional force between the port plate 60 and the first swash plate 30 increases transiently. Thus, there is a danger that a slippage in the rotation direction between the shoes 21 and the port plate 60 will develop.

Under conditions of this kind, the shoes 21 shift slightly in the rotation direction, and hit the retainer plate 70, causing the retainer plate 70 to rotate. The retainer plate 70 is joined to the port plate 60 by the pins 79. Accordingly, the port plate 60 can rotate reliably.

However, the port plate 60 is normally rotated by the frictional forces between it and the shoes 21. Consequently, the frequency with which force is applied to contact portions between the shoes 21 and the retainer plate 70, and to the pins 79 between the retainer plate 70 and the port plate 60 decreases, assuring durability of the contact portions and the pins 79.

Referring to FIG. 1, there are a total of two main sliding locations when the hydraulic motor 1 is driven, that is, the sliding portion of the port plate 60 with respect to the first swash plate 30, and the sliding portion of the shoes 21 with respect to the second swash plate 40. With a normal non-opposing type piston motor having one swash plate, there are a total of two main sliding locations, that is, the sliding portion of shoes with respect to the swash plate, and the sliding portion on the opposite side of the cylinder block, where the cylinder block contacts a valve plate. The number of main sliding locations is the same for both motor types, and thus friction does not increase during operation.

Further, a pitch circle diameter P.C.D of the cylinder block 4 can be made smaller with the hydraulic motor 1 compared to a conventional non-opposing type piston motor having an identical maximum capacity. Consequently, the hydraulic motor 1 can be made smaller. In addition, the size of the sliding portion of the port plate 60 with respect to the first swash plate 30, and the size of the sliding portion of the shoes 22 with respect to the second swash plate 40 are also cut in half. Accordingly, the relative sliding velocity becomes smaller, and high speed rotation of the motor becomes easier to accomplish.

The hydraulic motor 1 of this invention is compared here with a conventional non-opposing type piston motor in which a piston is only included in one side of a cylinder block.

The conventional non-opposing type piston motor being compared here is a swash plate variable motor, and is configured by a cylinder block having the same size pitch circle diameter and the same outer diameter, a piston having the same diameter, and a swash plate having the same maximum tilt angle, as those of the hydraulic motor 1 of this invention.

When the first swash plate 30 of the hydraulic motor 1 of this invention takes on a neutral position, and the second swash plate 40 takes on its maximum tilt angle (state shown in FIG. 8B), the displacement volume (effective capacity volume) is one-half of the maximum displacement volume. This volume is equal to that when the conventional non-opposing piston motor being compared is at its maximum tilt angle.

When compared in this state, there are a total of two sliding portions that serve as resistances against rotation with the conventional non-opposing type piston motor, that is, the sliding portion between the shoes and the swash plate, and the sliding portion between the cylinder block and the valve plate. Further, there is also sliding between each piston and the cylinder block.

On the other hand, in the hydraulic motor 1 of this invention, sliding takes place at one end between the shoes 22 and the second swash plate 40, and at the other end between the port plate 60 and the first swash plate 30. In addition, there is sliding between the second piston 9 on the second swash plate 40 side and the cylinder block 4, between the first piston 8 on the first swash plate 30 side and the cylinder block 4, and between the shoes 21 and the port plate 60.

In comparing the two motors, the sliding between the shoes 22 on the second swash plate 40 side and the second swash plate 40 in the hydraulic motor 1 of this invention is equivalent to the sliding in the conventional non-opposing type piston motor. Losses of drive force are also equivalent. Further, losses in drive force due to the sliding between the port plate 60 and the first swash plate 30 can be considered to be substantially equivalent to drive force losses due to the sliding between the cylinder block and the valve plate in the conventional non-opposing type piston motor because sliding members of both motors have equal size.

Similarly, losses in drive force in the motor of this invention due to sliding between the second piston 9 on the second swash plate 40 side and the cylinder block 4, and losses in drive force due to sliding in the same regions of the conventional non-opposing type piston motor can be said to be substantially equal.

Regarding the other remaining sliding locations, that is, the sliding between the first piston 8 on the first swash plate 30 side and the cylinder block 4, and the sliding between the shoes 21 and the port plate 60, excess losses in drive force are more liable to occur in the hydraulic motor 1 of this invention at these sliding locations. However, the first swash plate 30 is in a neutral position. Accordingly, the first piston 8 on the first swash plate 30 side does not stroke, and relative motion does not occur between the first piston 8 and the cylinder block 4. Further, the shoes 21 are pressed against the port plate 60, and relative motion does not occur therebetween. Consequently, it can be said that the losses in drive force in these portions are extremely small.

The hydraulic motor 1 of this invention can thus obtain an efficiency that is substantially equivalent to the efficiency of the conventional non-opposing type piston motor when the first swash plate 30 is in a neutral position. The conventional non-opposing type piston motor can in practice be used up to a capacity ratio (maximum capacity/minimum capacity) on the order of 2.5. This means that the hydraulic motor 1 of this invention can also be used at a capacity ratio on the order of 2.5, with respect to the maximum displacement volume of 2/1. This means that the capacity ratio of the hydraulic motor 1 of this invention with respect to the maximum capacity is 5.

Now, the efficiency at a maximum capacity position (state shown in FIG. 8A) of the hydraulic motor 1 of this invention is considered.

The maximum capacity occurs in a state where the first swash plate 30 and the second swash plate 40 are both tilted.

The conventional non-opposing type piston motor has one-half of the number of pistons compared to the hydraulic motor 1 of this invention. Consequently, it is necessary to increase the piston diameter in order to have the same capacity. The diameter of the cylinder block naturally must also be increased. When the piston size and the maximum swash plate tilt angle are equal, the pitch circle diameter becomes twice the pitch circle diameter of the motor of this invention.

In comparing the two motors with respect to drive force losses due to the various sliding members, as described above, the hydraulic motor 1 of this invention has overwhelmingly smaller losses between the shoes and the swash plates, and between the cylinder block and the valve plate (between the port plate 60 and the first swash plate 30 in the hydraulic motor 1 of this invention). On the other hand, with the sliding between the first piston 8 on the first swash plate 30 side and the cylinder block 4, and between the shoes 21 and the port plate 60 in this invention, the first piston 8 strokes and moves relative to the cylinder block 4. The shoes 21 also move minutely relative to the port plate 60. Consequently, the drive force losses increase in these portions more than those of the conventional non-opposing type piston motor.

When the relative advantages and disadvantages in terms of drive force losses described above are all totaled up, substantially the same level of the efficiency value at the maximum capacity position of the hydraulic motor 1 of this invention as that of the conventional non-opposing type piston motor.

A drive portion for tilting the first swash plate 30 is explained next.

A pair of drive pistons 33 and 34 that push the first swash plate 50 from behind are disposed in the port block 50. The tilt of the first swash plate 30 can be switched between two positions, a tilted position and an upright position (neutral position) by selectively controlling a drive pressure that is guided to the drive pistons 33 and 34 through switching operations of a tilt angle control valve discussed hereinafter. It should be noted that receiving portions 39*a* and 39*b* that receive the drive force from the drive pistons 33 and 34, respectively, are formed in the first swash plate 30.

Further, a pair of drive pistons 43 and 44 that push the second swash plate 40 from the rear are disposed in the case 25 as drive portions for tilting the second swash plate 40. By selectively controlling the drive pressure that is guided to the drive pistons 43 and 44 by using the tilt angle control valve (not shown), the tilt angle of the second swash plate 40 can also be switched between two levels. Receiving portions 49*a* and 49*b* that receive drive force from the rear surface drive pistons 43 and 44 are provided to the second swash plate 40.

In this case the tilt directions of the first swash plate 30 and the second swash plate 40 are set to be mutually opposite directions in FIG. 1. In other words, the first swash plate 30 rotates in the counter clockwise direction from an upright position, and the second swash plate 40 rotates in the clockwise direction from an upright position. In a state where the first swash plate 30 and the second swash plate 40 both tilt (shown in FIG. 8A), the volume change of the volume chamber 10 becomes maximum according to movement of the first piston 8 and the second piston 9. When only one of the first swash plate 30 and the second swash plate 40 tilts (FIG. 8B), the volume change of the volume chamber 10 takes on an intermediate value. In a state where the first swash plate 30 and the second swash plate 40 are both upright, the volume change of the volume chamber 10 becomes minimum (or becomes zero).

A hydraulic pressure control circuit for controlling the tilt angles of the first swash plate 30 and the second swash plate 40 is explained here.

Figure 9:
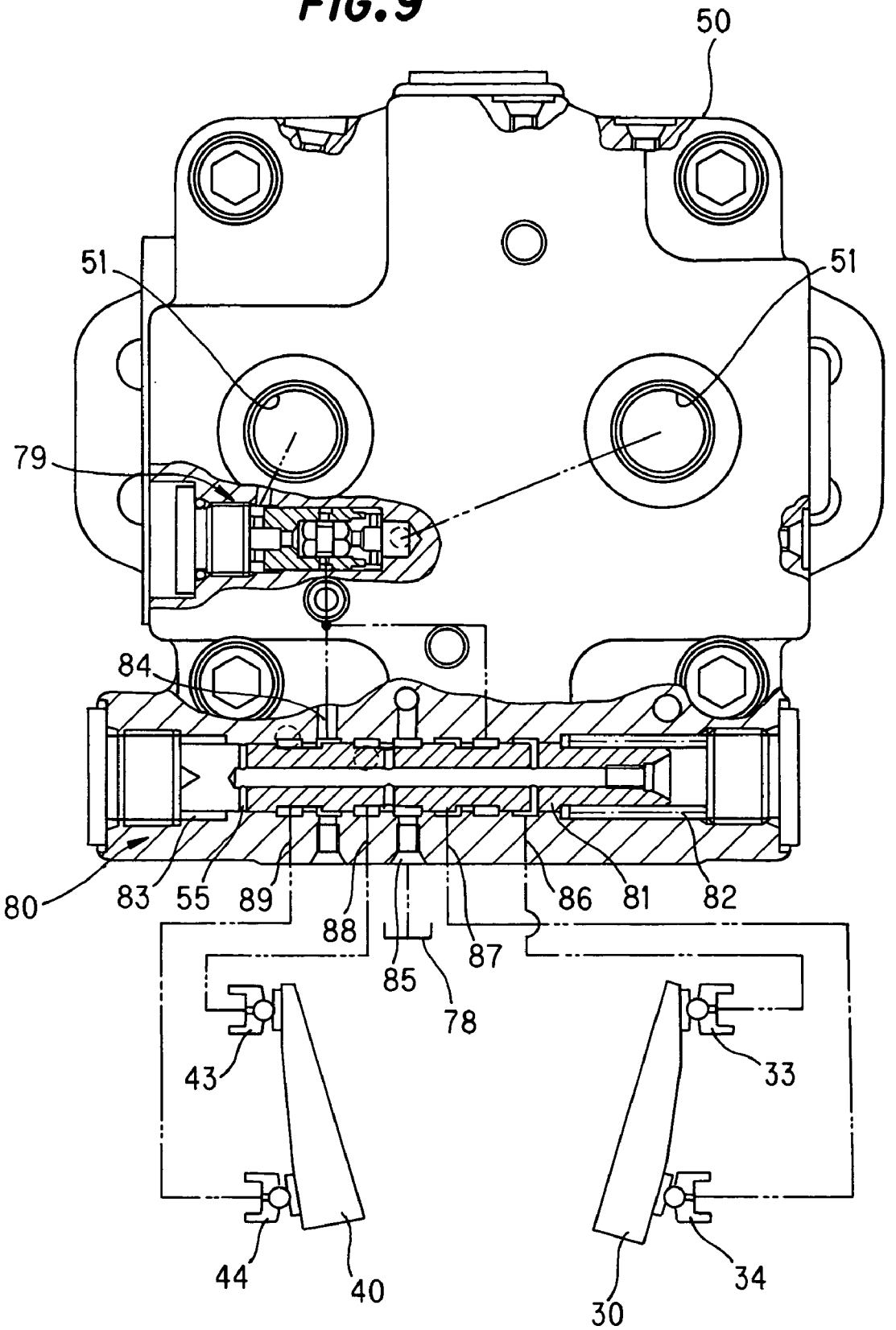
FIG. 9 is a cross sectional view that shows an L position of a tilt angle control valve.

Referring to FIG. 9, a tilt angle control valve 80 and a shuttle valve 79, both of which are explained hereinafter, are contained in the port block 50. The tilt angle control valve 80 and the shuttle valve 79 control the hydraulic pressures that are guided to the drive pistons 33 and 34 and drive pistons 43 and 44 which are disposed in the rear surfaces of the first swash plate 30 and the second swash plate 40, respectively, thus causing the tilt angle of the first swash plate 30 and the tilt angle of the second swash plate 40 to change.

The shuttle valve 79 selects the higher of pressures that develop at the pair of entrance and exit openings 51, and guides that pressure to the tilt angle control valve 80 as drive pressure for the first swash plate 30 and the second swash plate 40.

The tilt angle control valve 80 comprises a spool 81 that is contained in a valve hole 55 formed in the port block 50 so as to be free to slide, and a valve drive pressure chamber 83 to which a pilot pressure is guided, driving the spool 81 against the force of a return spring 82. The pilot pressure is guided to the valve drive chamber 83 from a proportional electromagnetic valve. The pilot pressure can be switched among three levels. The tilt angle control valve can thus be switched among an "L" position shown in FIG. 9 where the tilts of the first swash plate 30 and the swash plate 40 are maximum, an "M" position shown in FIG. 10 where the tilt of the first swash plate 30 is minimum (upright state) and the tilt of the second swash plate 40 is maximum, and an "H" position shown in FIG. 11 where the tilts of the first swash plate 30 and the second swash plate 40 are minimum.

A drive pressure introduction port 84 that guides drive pressure from the shuttle valve 79, a drain port 84 that guides drain pressure from a reservoir 78, and four piston drive pressure ports 86 to 89 that communicate with the drive pistons 33 and 34 and the drive pistons 43 and 44, respectively, are opened in an inner circumference of the valve hole 55.

The piston drive pressure ports 86 to 89 selectively communicate with the drive pressure introduction port 84 or the drain port 84 according to the sliding position of the spool 81.

Referring to FIG. 9, when the lowest pilot pressure is guided to the valve drive chamber 83, the tilt angle control valve 80 maintains the "L" position due to an urging force of the return spring 82. In the "L" position, the drive pistons 34 and 44 communicate with the drive pressure introduction port 84, and the drive pistons 33 and 43 communicate with the drain port 85.

Figure 8A:
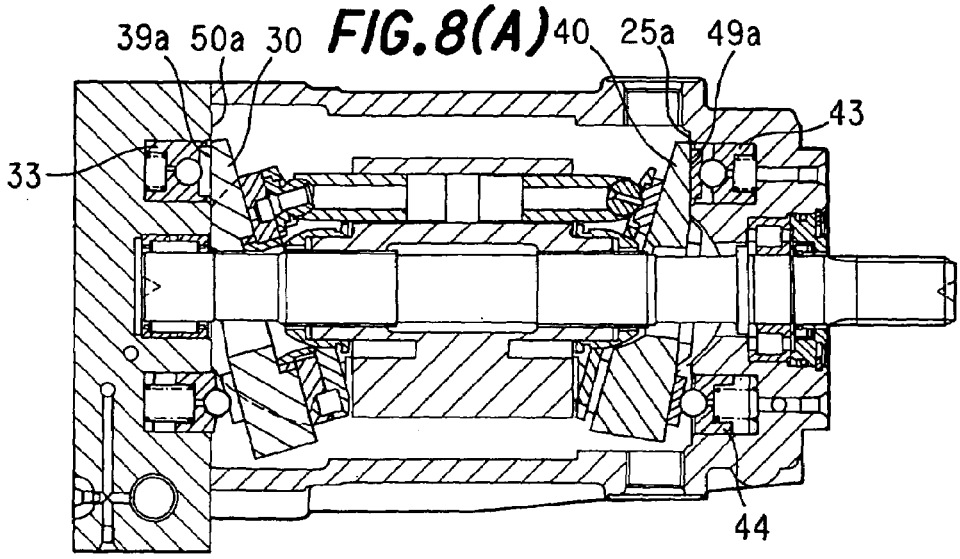
FIGS. 8A, 8B, and 8C are cross sectional views that show operation states of the hydraulic motor.

High pressure is thus guided to the drive pistons 34 and 44 in the "L" position, while low pressure is guided to the drive pistons 33 and 43. As shown in FIG. 8A, the tilts of the first swash plate 30 and the second swash plate 40 become maximum, and the receiving portions 39*a* and 49*a* contact an end surface 50*a* of the port block 50 and a bottom surface 25*a* of the case 25, respectively. The displacement volume of the hydraulic motor 1 thus becomes a maximum value, 60 $cm^3$/rev, for example.

Figure 10:
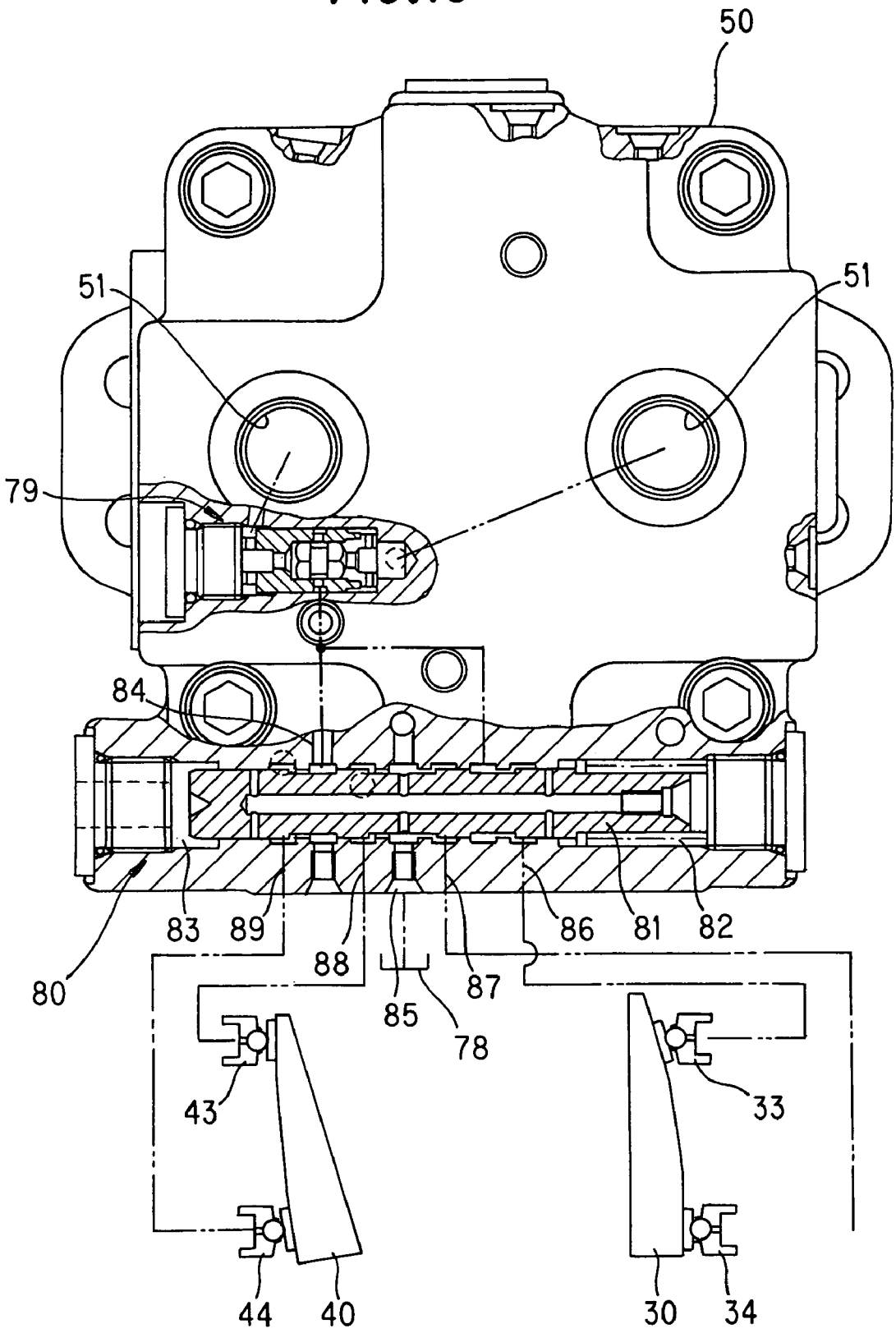
FIG. 10 is a cross sectional view that similarly shows an M position of the tilt angle control valve.

Referring to FIG. 10, when an intermediate pilot pressure is guided to the valve drive chamber 83, the tilt angle control valve 80 maintains the "M" position where the pressure of the valve drive pressure chamber 83 and the urging force of the return spring 82 are in balance with each other. In the "M" position, the drive pistons 33 and 44 communicate with the drive pressure introduction port 84, and the drive pistons 34 and 43 communicate with the drain port 85.

Figure 8B:
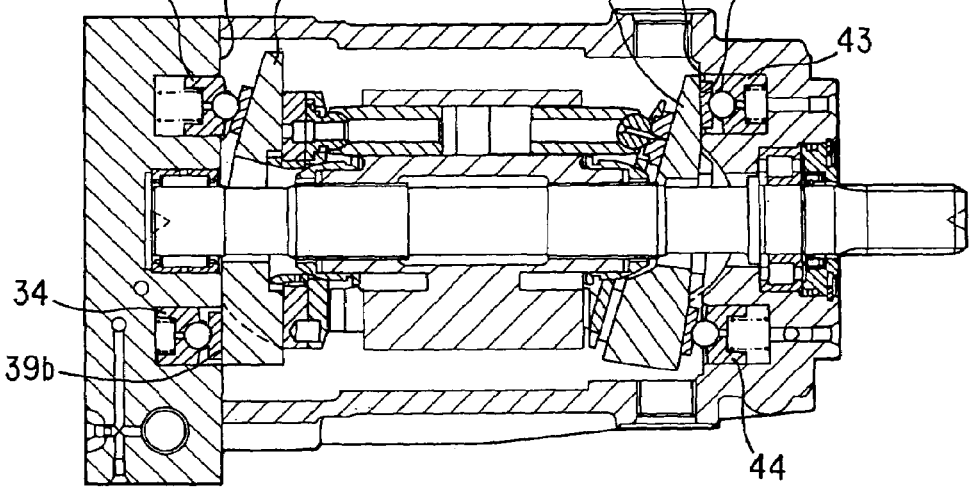

Referring to FIG. 8B, in the "M" position, the tilt of the first swash plate 30 thus becomes minimum, and the receiving portion 39*b* contacts the end surface 50*a* of the port block 50. The tilt of the second swash plate 40 becomes maximum, and the receiving portion 49*a* contacts the bottom surface 25*a* of the case 25. The displacement volume of the hydraulic motor 1 thus becomes an intermediate value, 30 $cm^3$/rev, for example.

Figure 11:
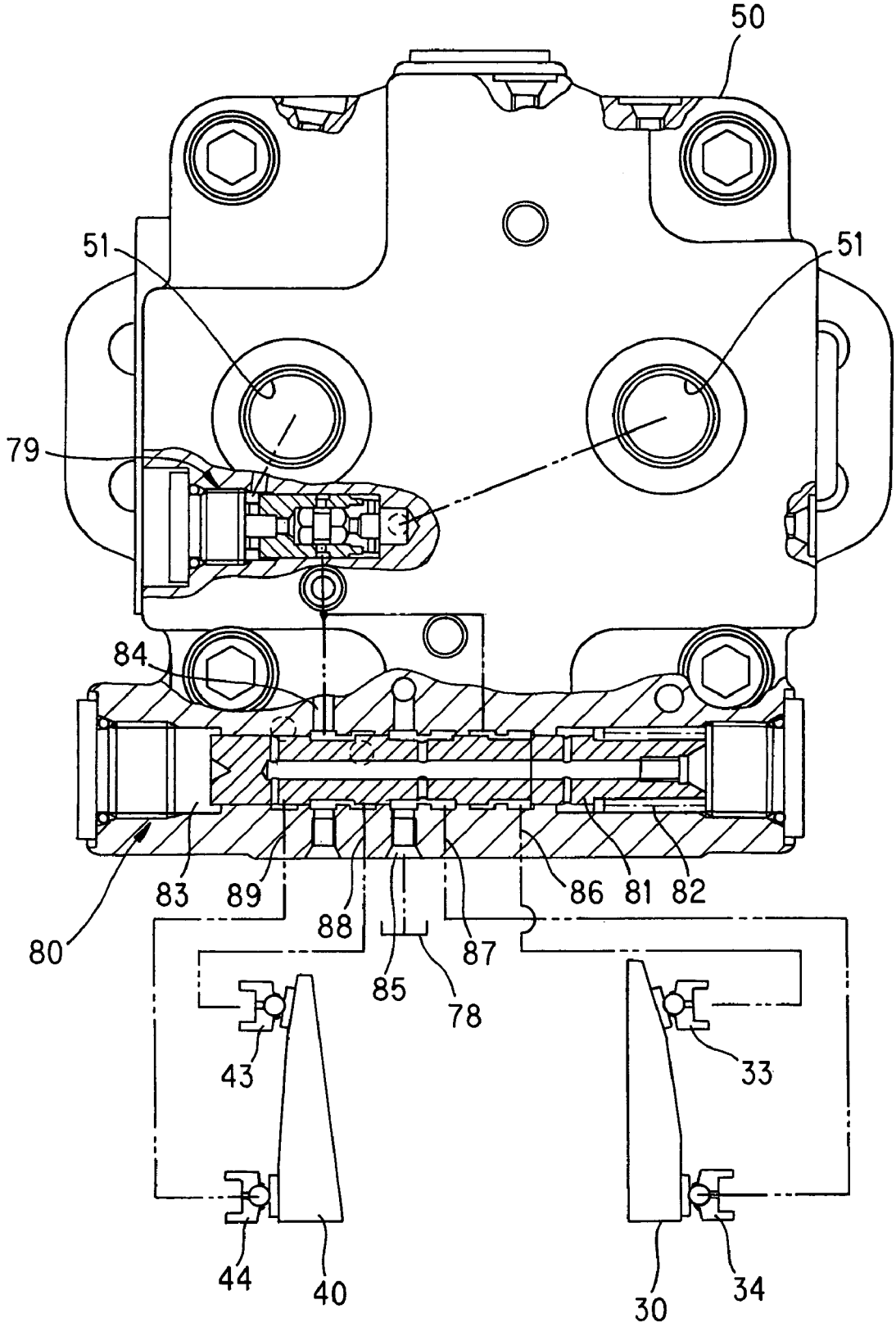
FIG. 11 is a cross sectional view that similarly shows an H position of the tilt angle control valve.

Referring to FIG. 11, when a maximum pilot pressure is guided to the valve drive chamber 83, the tilt angle control valve 80 maintains the "H" position, resisting the urging force of the return spring 82. In the "H" position, the drive pistons 33 and 43 communicate with the drive pressure introduction port 84, and the drive pistons 34 and 44 communicate with the drain port 85.

Figure 8C:
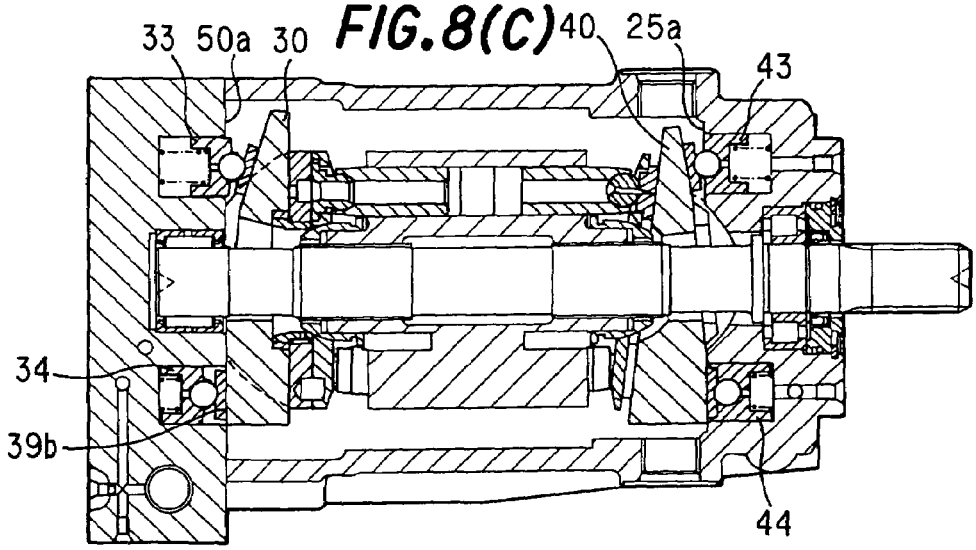

High pressure is thus guided to the drive pistons 33 and 43 in the "H" position, while low pressure is guided to the drive pistons 34 and 44. Referring to FIG. 8C, the tilts of the first swash plate 30 and the second swash plate 40 thus become minimum, and the receiving portions 39*b* and 49*b* contact the end surface 50*a* of the port block 50 and the bottom surface 25*a* of the case 25, respectively. The displacement volume of the hydraulic motor 1 thus becomes a minimum value, 12 $cm^3$/rev, for example.

It thus becomes possible to increase the valuable capacity ratio to a value that is substantially twice that of the conventional piston motor by switching the tilt angles of the first swash plate 30 and the second swash plate 40.

The capacity of the hydraulic motor 1 switches between three levels by switching the tilt angle control valve 80 to the "L", "M", and "H" positions. When the hydraulic motor 1 is used in a hydrostatic transmission (HST), it becomes possible to control vehicle speed across the entire speed range by switching the gear ratio among three states according to the operation amount of a speed lever.

In other words, by operating the speed lever, a signal indicative of the operation amount changes the amount of electric current flowing in the proportional magnetic valve. The pilot pressure that is output from the proportional magnetic valve thus changes in proportion to the electric current, and switching of the tilt angle control valve 80 is performed according to the pilot pressure. The effective capacity of the hydraulic motor 1 can be switched between the "L", "M", and "H" positions.

The hydrostatic transmission is configured by combining the hydraulic motor 1 with a hydraulic pump that supplies hydraulic fluid to the hydraulic motor 1. However, the discharge amount of the hydraulic pump is also variably controlled. Consequently, it is possible to freely control the vehicle speed from zero up to a maximum speed by variable control of the capacity of the hydraulic motor 1 and variable control of the discharge amount of the hydraulic pump.

It should be noted that the hydraulic motor 1 is configured to switch the position of the tilt angle control valve 80 in three stages by using one proportional electromagnetic valve. Accordingly, the number of proportional electromagnetic valves used is kept to a minimum, and a complex structure is avoided.

Figure 12:
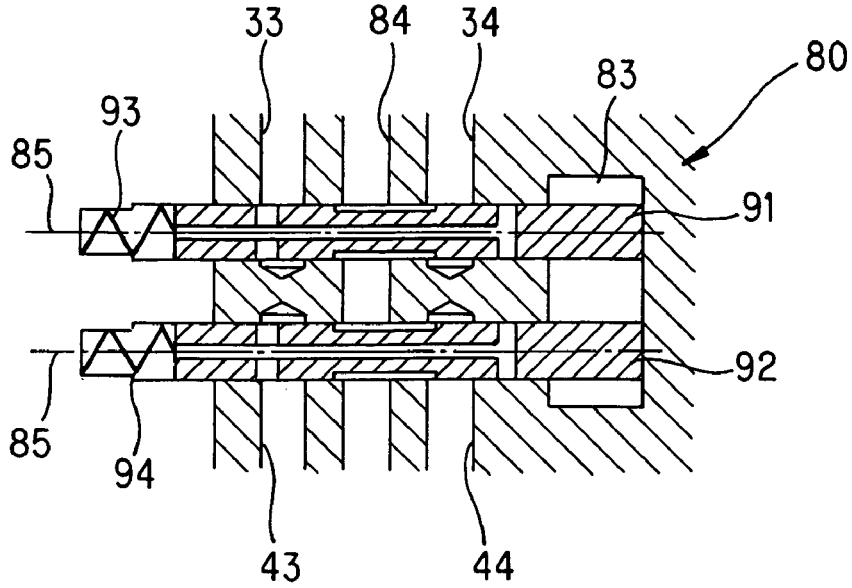
FIG. 12 is a cross sectional view of another embodiment of a tilt angle control valve.

Another embodiment of the tilt angle control valve 80 shown in FIG. 12 is explained next. It should be noted that identical symbols are used for structural portions that are identical to those of the embodiment described above.

The tilt angle control valve 80 comprises two spools 91 and 92 that are arranged in parallel, and two return springs 93 and 94 that urge the spools 91 and 92, respectively. An urging force of the return spring 93 is set to be smaller than that of the return spring 94. One end of each of the spools 91 and 92 faces the common valve drive pressure chamber 83. The spools 91 and 92 operate in order, resisting the return springs 93 and 94, respectively, according to increases in the pilot pressure guided to the valve drive pressure chamber 83. Positions of the tilt angle control valve 80 are thus changeable in three stages.

In the "L" position where the lowest pilot pressure is guided to the valve drive pressure chamber 83, the spools 91 and 92 maintain positions shown in FIG. 12 due to the urging forces of the return springs 93 and 94, respectively.

In the "M" position where an intermediate pilot pressure is guided to the valve drive pressure chamber 83, the spool 91 slides while resisting the return spring 93, and the spool 92 maintains the position shown in FIG. 12 due to the urging force of the return spring 94.

In the "H" position where the highest pilot pressure is guided to the valve drive pressure chamber 83, the spools 91 and 92 slide while resisting the urging forces of the return springs 93 and 94, respectively.

In this case as well, the position of the tilt angle control valve 80 is switched in three stages by one proportional magnetic valve, similar to the embodiment described above. Accordingly, a complex structure can be avoided, and this is advantageous from the viewpoint of costs.

Furthermore, passage arrangement can be simplified by using a structure in which the two spools 91 and 92 are provided.

Figure 13:
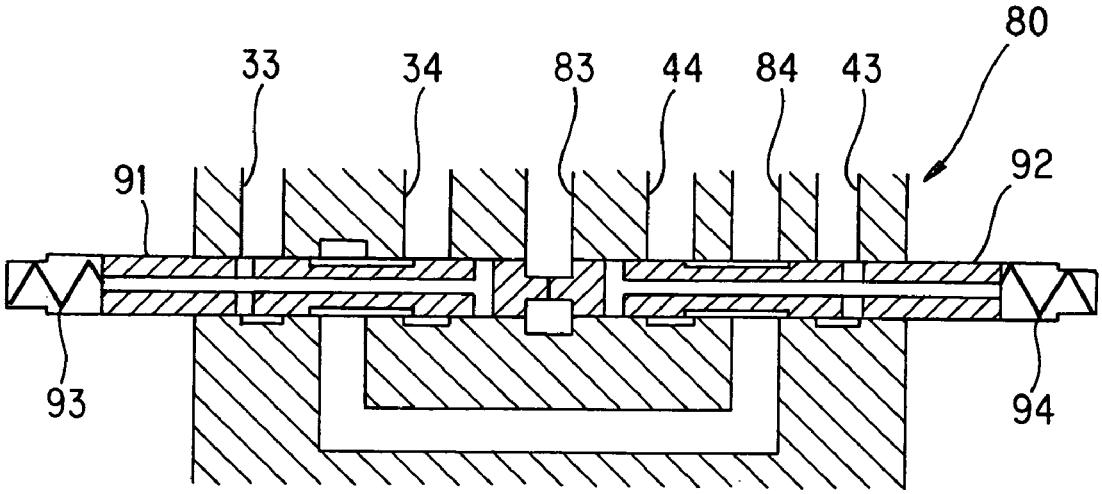
FIG. 13 is a cross sectional view of yet another embodiment of a tilt angle control valve.

In addition, FIG. 13 shows yet another embodiment of this invention.

The two spools 91 and 92 are disposed in series in the tilt angle control valve 80. The valve drive pressure chamber 83 is provided at a center position where the two spools 91 and 92 contact. The spools 91 and 92 move in mutually opposite directions due to the pilot pressure supplied to the valve drive pressure chamber 83, thus performing valve switching. The spools 91 and 92 are urged toward initial positions by the return springs 93 and 94, respectively. The magnitudes of the urging forces of the return springs 93 and 94 are the same as those of FIG. 6, and switching is performed between the "L", "M", and "H" positions, as described above.

It should be noted that a potentiometer which detects the tilt angle of each of the swash plates may also be provided to perform feedback control based on detected signals to make the tilt angles of the swash plates approach target values.

Figure 14:
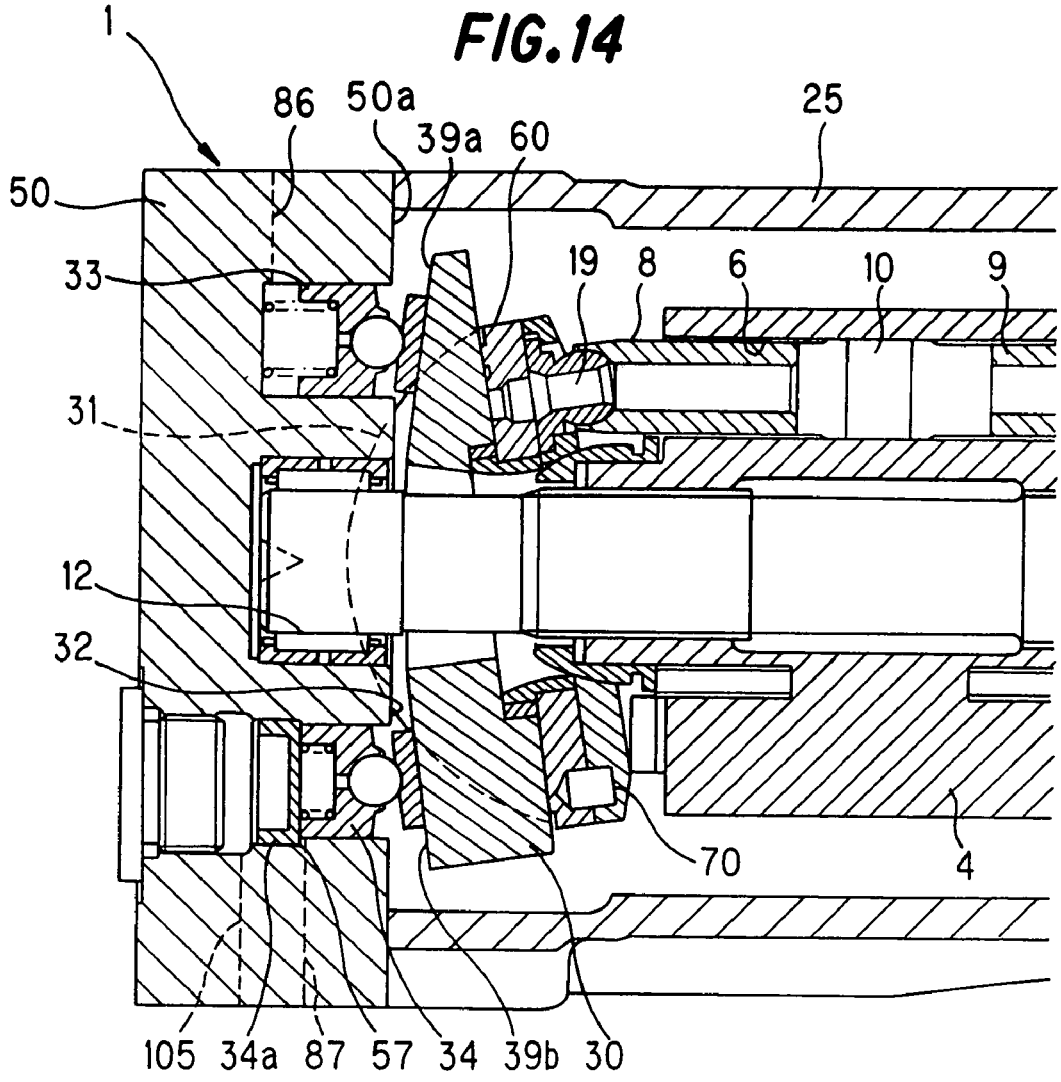
FIG. 14 is a cross sectional view of another embodiment of a hydraulic motor.

Another embodiment of this invention shown in FIG. 14 is one with which it is possible to switch the tilt angle of the first swash plate 30 in three stages, not in two stages.

The pair of drive pistons 33 and 34 that push the first swash plate 30 from behind are disposed in the port block 50 as drive positions that tilt the first swash plate 30. In addition, an intermediate position control piston 34*a* is disposed behind the drive piston 34. The tilt angle of the first swash plate 30 thus switches in three stages.

The outer diameter of the intermediate position control piston 34*a* is made larger than that of the drive piston 34. Drive pressure guided from a tilt angle control valve 100 shown in FIG. 15 pushes the drive piston 34 out toward the first swash plate 30.

A step portion 57 is formed in a cylindrical hole that houses the intermediate position control piston 34*a*. In a state where the intermediate position control piston 34*a* contacts the step portion 57, the first swash plate 30 maintains an intermediate position through the drive position 34.

Figure 15:
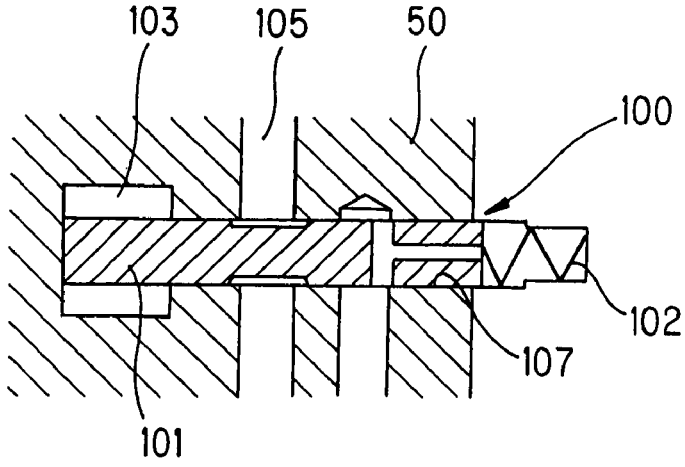
FIG. 15 is a cross sectional view of a still further embodiment of a tilt angle control valve.

Referring to FIG. 15, the tilt angle control valve 100 comprises a spool 101 that is contained in a valve hole 107 of the port block 50 so as to be free to slide, and a valve drive pressure chamber 103 to which a pilot pressure that drives the spool 101 against the force of a return spring 102 is guided. The pilot pressure is guided to the valve drive pressure chamber 103 from a second proportional electromagnetic valve (not shown). The valve 100 thus moves, and drive pressure is guided to the intermediate position control piston 34*a* via a passage 105.

In the "L" position, low pressure is guided to the drive piston 33, high pressure is guided to the drive piston 34, and low pressure is guided to the intermediate position control piston 34*a*. The drive piston 34 thus projects out, and the drive piston 33 is pulled in.

In the intermediate position shown in FIG. 14, high pressure is guided to the drive piston 33, low pressure is guided to the drive piston 34, and high pressure is guided to the intermediate position control piston 34*a*. The drive piston 34 is thus pushed by the intermediate position control piston 34*a*, and projects out. At this point the first swash plate 30 is pushed by both the drive pistons 33 and 34. However, the outer diameter of the intermediate position control piston 34*a* is larger than that of the drive piston 33. Consequently, the intermediate position control piston 34*a* maintains a position in contact with the step portion 57 while resisting the drive piston 33.

In the "M" position, high pressure is guided to the drive piston 33, low pressure is guided to the drive piston 34, and low pressure is guided to the intermediate position control piston 34*a*. The drive piston 34 is thus pulled in, and the drive piston 33 projects out.

It thus becomes possible for the hydraulic motor 1 to switch between four positions by the tilt angle of the first swash plate 30 switching in three stages, and the tilt angle of the second swash plate 40 switching in two stages.

It should be noted that a configuration may be adopted in which the tilt angle of the second swash plate 40 also changes in three stages through the intermediate position control piston 34*a*.

This invention is not limited to the embodiments described above. This invention can also be applied to a piston pump as a swash plate type hydrostatic pump or motor. A variety of modifications may be made within the technical scope of this invention.

What is claimed is:

1. A swash plate type pump or motor, comprising:

a cylinder block supported within a pump case so as to freely rotate;

a plurality of first cylinder bores and a plurality of second cylinder bores which are formed axially on both sides of the cylinder block, the first cylinder bores and the second cylinder bores communicating with each other;

first pistons and second pistons which are inserted into the first cylinder bores and the second cylinder bores from both of the sides of the cylinder block;

volume chambers formed in inner portions of the first cylinder bores and the second cylinder bores and defined by the first pistons and the second pistons;

a first swash plate and a second swash plate which are disposed axially on both of the sides of the cylinder block and to which the first pistons and the second pistons contact freely to slide, respectively;

a first swash plate bearing and a second swash plate bearing which support the first swash plate and the second swash plate so as to be free to tilt, respectively;

drive pistons that cause the first swash plate and the second swash plate to tilt;

a hydraulic pressure control valve which selectively controls hydraulic pressure acting on the drive pistons;

a pair of supply and discharge ports formed in a sliding surface of the first swash plate, the pair of supply and discharge ports being connected to a hydraulic fluid high pressure side and a hydraulic fluid low pressure side, respectively;

a port plate disposed in a sliding portion between the first swash plate and the first pistons, the port plate rotating integrally with the cylinder block and guiding the high pressure side hydraulic fluid and the low pressure side hydraulic fluid of the supply and discharge ports to the volume chambers via inner portions of the first pistons, the port plate being formed in a hollow disk shape and comprising a plurality of valve ports whose number is equal to a number of the first pistons, the plurality of valve ports being formed at equal intervals in a circumferential direction of the port plate;

piston shoes connected to the first pistons; and shoe ports formed on the piston shoes that communicate with pass through passages in the inner portions of the first pistons;

wherein each of the shoe ports communicates with each of the valve ports;

wherein a frictional force of the port plate with respect to the first swash plate is set to be smaller than a frictional force of the piston shoes with respect to the port plate; and wherein sizes of pressure receiving surface areas that receive the hydraulic fluid pressure are set to cause a hydraulic pressure reaction force that acts on a contact surface between the port plate and the first swash plate to become larger than a hydraulic pressure reaction force that acts on a contact surface between the piston shoes and the port plate.

2. A swash plate type pump or motor, comprising:

a cylinder block supported within a pump case so as to freely rotate;

a plurality of first cylinder bores and a plurality of second cylinder bores which are formed axially on both sides of the cylinder block, the first cylinder bores and the second cylinder bores communicating with each other;

first pistons and second pistons which are inserted into the first cylinder bores and the second cylinder bores from both of the sides of the cylinder block;

volume chambers formed in inner portions of the first cylinder bores and the second cylinder bores and defined by the first pistons and the second pistons;

a first swash plate and a second swash plate which are disposed axially on both of the sides of the cylinder block and to which the first pistons and the second pistons contact freely to slide, respectively;

a first swash plate bearing and a second swash plate bearing which support the first swash plate and the second swash plate so as to be free to tilt, respectively:;

drive pistons that cause the first swash plate and the second swash plate to tilt;

a hydraulic pressure control valve which selectively controls hydraulic pressure acting on the drive pistons;

a pair of supply and discharge ports formed in a sliding surface of the first swash plate, the pair of supply and discharge ports being connected to a hydraulic fluid high pressure side and a hydraulic fluid low pressure side, respectively; and a port plate disposed in a sliding portion between the first swash plate and the first pistons, the port plate rotating integrally with the cylinder block and guiding the high pressure side hydraulic fluid and the low pressure side hydraulic fluid of the supply and discharge ports to the volume chambers via inner portions of the first pistons;

wherein the first swash plate and the second swash plate are adapted to tilt in mutually opposite directions from neutral positions thereof; and wherein the drive pistons which drive each of the first swash plate and the second swash plate comprise a pair of drive pistons that are disposed on opposite sides across a rotation axis of each of the first swash plate and the second swash plate.

3. The swash plate type pump or motor as defined in claim 2, wherein the hydraulic control valve performs control to cause high pressure to be guided to one of the pair of drive pistons and to cause low pressure to be guided to the other of the pair of drive pistons.

4. The swash plate type pump or motor as defined in claim 3, wherein the first swash plate and the second swash plate switch between a position where a tilt of the first swash plate and a tilt of the second swash plate are both maximum, a position where the tilt of the first swash plate is minimum and the tilt of the second swash plate is maximum, and a position where the tilt of the first swash plate and the tilt of the second swash plate are both minimum.

* * * * *